US008402662B1

(12) United States Patent
Douzanis

(10) Patent No.: US 8,402,662 B1
(45) **Date of Patent: *Mar. 26, 2013**

(54) KNIFE OPENING ASSIST

(76) Inventor: Ronald E. Douzanis, Lakeville, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/274,295

(22) Filed: Oct. 14, 2011

Related U.S. Application Data

(63) Continuation-in-part of application No. 11/818,626, filed on Jun. 15, 2007, now Pat. No. 8,065,804, which is a continuation-in-part of application No. 11/100,030, filed on Apr. 5, 2005, now abandoned.

(51) Int. Cl.
*B26B 1/08* (2006.01)
*B26B 29/02* (2006.01)

(52) U.S. Cl. ..... 30/161; 30/158; 30/160; 30/162

(58) Field of Classification Search ..... 30/161, 30/158, 160, 162, 155, 164, 295, 153, 152, 30/154, 156, 157, 159, 163; D8/14, 55, 21, D8/22, 23, 83, 87, 93, 94
See application file for complete search history.

(56) References Cited

U.S. PATENT DOCUMENTS

| | | | |
|---|---|---|---|
| 108,141 | A | 10/1870 | Houseman et al. |
| 303,855 | A | 8/1884 | Hunt |
| 369,314 | A | 9/1887 | Brougher |
| 431,584 | A | 7/1890 | Holland |
| 552,077 | A | 12/1895 | Wagner |
| 847,474 | A | 3/1907 | Hawley |
| 947,980 | A | 2/1910 | Romano |
| 1,750,577 | A | 3/1930 | Bracht |
| 2,793,891 | A | 5/1957 | Frye |
| D228,545 | S | 10/1973 | Beddick |
| 4,095,337 | A | 6/1978 | Pharr |
| 5,009,008 | A | 4/1991 | Yablonovitch |
| D333,859 | S | 3/1993 | Meyer |
| 5,511,311 | A | 4/1996 | Collins |
| D379,294 | S | 5/1997 | Lum |
| D382,459 | S | 8/1997 | Khalsa |
| 5,769,094 | A | 6/1998 | Jenkins, Jr. et al. |
| D397,282 | S | 8/1998 | Derkatz |
| D405,338 | S | 2/1999 | Balolia |
| 5,878,500 | A | 3/1999 | Emerson |
| D422,871 | S | 4/2000 | Terzuola |
| D425,391 | S | 5/2000 | Bradichansky |
| D441,827 | S | 5/2001 | Frank |
| D461,387 | S | 8/2002 | Glesser |
| D461,681 | S | 8/2002 | Lothe |
| 6,553,672 | B2 | 4/2003 | Glesser et al. |
| 6,725,545 | B2 | 4/2004 | Frank |
| D493,087 | S | 7/2004 | Wong |
| 7,036,229 | B1 | 5/2006 | Demko |
| 7,380,341 | B2 | 6/2008 | Ping |
| 2002/0066187 | A1 | 6/2002 | Jennings |
| 2002/0104220 | A1 | 8/2002 | Marfione |
| 2003/0009886 | A1 | 1/2003 | Onion |
| 2004/0020058 | A1 | 2/2004 | Vallotton |
| 2004/0045171 | A1 | 3/2004 | Moizis |
| 2006/0064877 | A1 | 3/2006 | Vallotton et al. |

*Primary Examiner* — Ghassem Alie
(74) *Attorney, Agent, or Firm* — Milstein Zhang & Wu LLC; Joseph B. Milstein

(57) ABSTRACT

A removable knife opening assist for a folding knife. The removable knife opening assist includes a hook and an attachment portion. The folding knife is configured to be stored in a folded condition in a container. The removable knife opening assist is configured to snag the container so that the folding knife is automatically opened for use when the folding knife is withdrawn from the container, without the need to manipulate the knife, other than the simple withdrawal of the folding knife from the container.

8 Claims, 13 Drawing Sheets

FIG. 18A
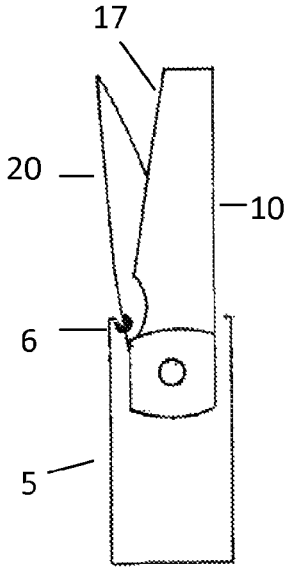
FIG.18B
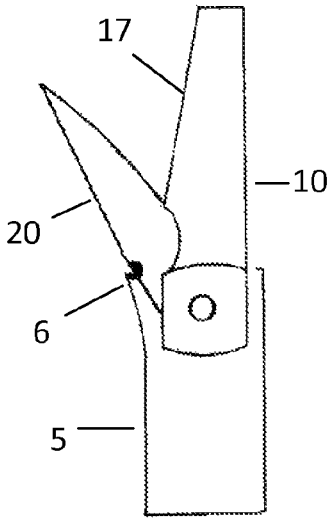
FIG. 18C
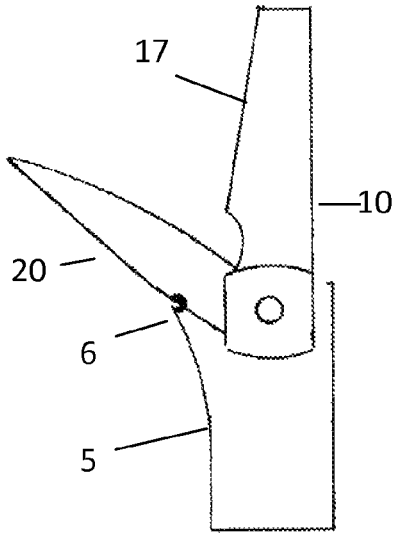
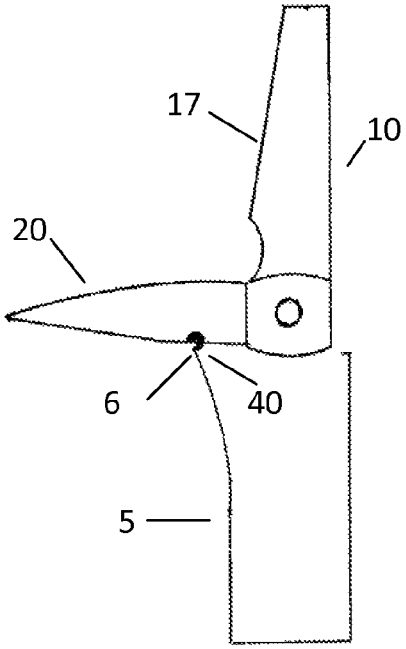
FIG. 18D
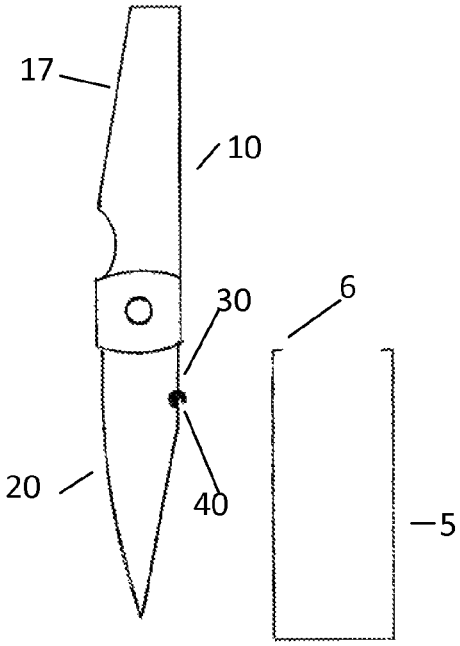
FIG.18E

KNIFE OPENING ASSIST

CROSS-REFERENCE TO RELATED APPLICATIONS

This application is a continuation-in-part of U.S. patent application Ser. No. 11/818,626 filed Jun. 15, 2007, issued as U.S. Pat. No. 8,065,804 on Nov. 29, 2011, which application was a continuation-in-part of then U.S. patent application Ser. No. 11/100,030 filed Apr. 5, 2005, now abandoned, each of which applications is incorporated herein by reference in its entirety.

FIELD OF THE INVENTION

This invention relates to folding knives, which includes folding pocket knives.

BACKGROUND OF THE INVENTION

Handheld folding knives have been used for many years for self-defense. Using a folding knife as a weapon first requires withdrawing the knife from a contained location, such as from a pocket, a sheath, a holster, or a container. The second aspect of using a folding knife as a weapon is to unfold the knife. Using a folding knife can be significantly difficult in a stressful situation, such as self-defense. Stress increases the difficulty of performing ordinary motor skills. Advanced motor skills often require extensive and dedicated training. When an individual is confronted with a situation that demands stress management and the execution of advanced motor skills, a successful outcome may be very challenging.

As mentioned, achieving a successful draw and unfolding of a folding knife while under stress requires training. Envision drawing a weapon while managing a physical attack. The isolated routine of a draw is now combined with a multitude of movements which severely complicate the process. Now envision the requisite skill and composure to unfold the knife. In practice, the draw and unfolding of a folding knife is measured not in seconds, but in fractions of a second. Therefore, a means for enabling the simultaneous drawing and unfolding of a folding knife will increase survivability.

The basic concept behind a folding knife is that it can be stored in a pocket or container. A folding knife occupies a small amount of space in one's pocket and is also safe to handle when in the folded position as the blade is securely stored in the handle.

Historically, folding knives have been opened with two hands (e.g., the "Swiss Army" knife) but this operation has evolved to single-handed operation. There are a number of ways to open folding knives with one hand. The most common single-hand operation is to use the thumb to engage some geometry that is designed to increase the thumb's leverage on the blade. See for example U.S. Pat. No. 4,095,337 to Pharr. These geometries come in many shapes and sizes. Some geometries are formed out of the blade itself while others are attachments which are fastened to the blade in various ways. Another single-handed operation is the wrist-flick method. This method is facilitated by reducing the blade's pivoting resistance so that a quick flick of the wrist swings the blade into an unfolded and locked position. Yet another single-handed operation of folding knives is the classic switchblade. By depressing a release button on the knife, a retaining latch is opened, allowing a spring-loaded blade to unfold to a locked position. These methods do not meet the special needs described above.

Thus, there is a need for providing apparatus and procedures for modifying a conventional folding knife so that the knife may be drawn and unfolded automatically and speedily. It would be advantageous to be able to open a folding knife with the use of only one hand to draw the knife. It would be advantageous that the procedure not require any additional hand or finger manipulation of the folding knife to unfold it during removal from a container, other than gripping the knife and simply withdrawing it from a holster, pocket or other container.

SUMMARY OF THE INVENTION

The opening method of interest with the present invention uses a snagging geometry. This apparatus and method is based upon an attachment to a folding knife blade that has a geometry designed to snag a holster, pocket or other container, while the folded knife is being drawn out. As used herein, the term folding knife includes a folding knife generally, and in some embodiments, a folding pocket knife. Although the remainder of this description will use the terms "folding knife" and "folding pocket knife," it is to be understood that a folding knife of all compatible types is contemplated. The inherent characteristic of the geometry provided in the following description automatically and speedily leverages the folding pocket knife blade open as the folding pocket knife is drawn out of the container. The snagging geometry is even capable of automatically unfolding folding pocket knives as they are withdrawn from the holster, pocket or other container using a string or lanyard attached to the end of the knife located at the opening of the holster, pocket or other container. The folding pocket knife is unfolded, even without being held in a hand or without being manipulated by a hand at all, by the simple interaction of the knife opening assist described herein with a holster, pocket or other container. No hand or finger manipulation of the folding pocket knife is required to cause it to unfold.

The snagging geometry preferably is oriented in the holster, pocket or other container so that, when drawn, the mechanical feature will properly engage the appropriate aspect of the holster, pocket or other container.

The prior art discloses snagging geometries formed as an integral part of the blade itself. See for example U.S. Pat. No. 5,878,500 to Emerson. However, nothing in the prior art provides geometries in the form of a removable attachment specifically adapted for opening the blade of a folding pocket knife by snagging a holster, pocket or other container while the knife is being drawn.

The purpose of the present invention is to permit a folding knife to be drawn and opened as quickly as a fixed blade knife is drawn. By attaching the knife opening assist of the present invention to a blade of a folding knife, this objective is attained.

According to one aspect, the invention features a removable knife opening assist for use in conjunction with a pre-existing folding knife having a blade with a sharp edge, a blade secondary edge opposite to the sharp edge, and a sharp tip, the folding knife having the blade foldably attached to a knife handle, the removable knife opening assist for use in conjunction with a pre-existing container for containing the folding knife in a folded condition. The removable knife opening assist comprises an upwardly and forwardly projecting hook; and an attachment element connected to the hook and configured to removably attach the hook to the portion of the blade secondary edge opposite to the sharp blade edge of the folding knife, the hook projecting in the direction of a front end of the attachment element, the hook configured to face toward a sharp tip of the blade of the folding knife so as to snag the holster, pocket or other container as the folding knife is being drawn out of the holster, pocket or other container for use; the removable knife opening assist configured to automatically open the folding pocket knife during removal of the folding knife from the holster, pocket or other container, and the removable knife opening assist configured to not require any manipulation of the removable knife opening assist during removal other than the simple withdrawal of the folding pocket knife from the holster, pocket or other container. In some embodiments the folding knife is used in conjunction with a clip that is provided so that the folding knife is properly oriented in the holster, pocket or other container.

In one embodiment, the attachment element comprises at least one screw.

In another embodiment, the attachment element comprises at least one spring enabled latch.

In yet another embodiment, the attachment element comprises at least one removable pin.

In still another embodiment, the attachment element comprises one threaded stud.

In a further embodiment, the removable knife opening assist further comprises an alignment portion having a channel formed therein, the channel configured to position the alignment portion over a portion of the blade secondary edge opposite to a sharp blade edge of the folding knife; the alignment portion connected to the hook and to the attachment portion.

In yet a further embodiment, the attachment element comprises a threaded attachment element.

In an additional embodiment, the attachment element comprises a clip attachment element.

The present invention provides a knife opening assist which is removably attached to any existing folding knife blade. The assist is comprised of an attachment element with a channel formed therein for positioning over a portion of any blade edge opposite to a sharp blade edge. The attachment element is attached to the blade by an attachment portion in the element. The top of the attachment element has a hook-shaped element hooking toward the forward end of the blade, the hook adapted to snag a pocket, holster or other container as the pocket knife is being drawn out for use.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIGS. 18A-18E are cutaway side views of a knife and container in various stages of withdrawal according to one embodiment of the invention.

DETAILED DESCRIPTION

Figures 1, 2:
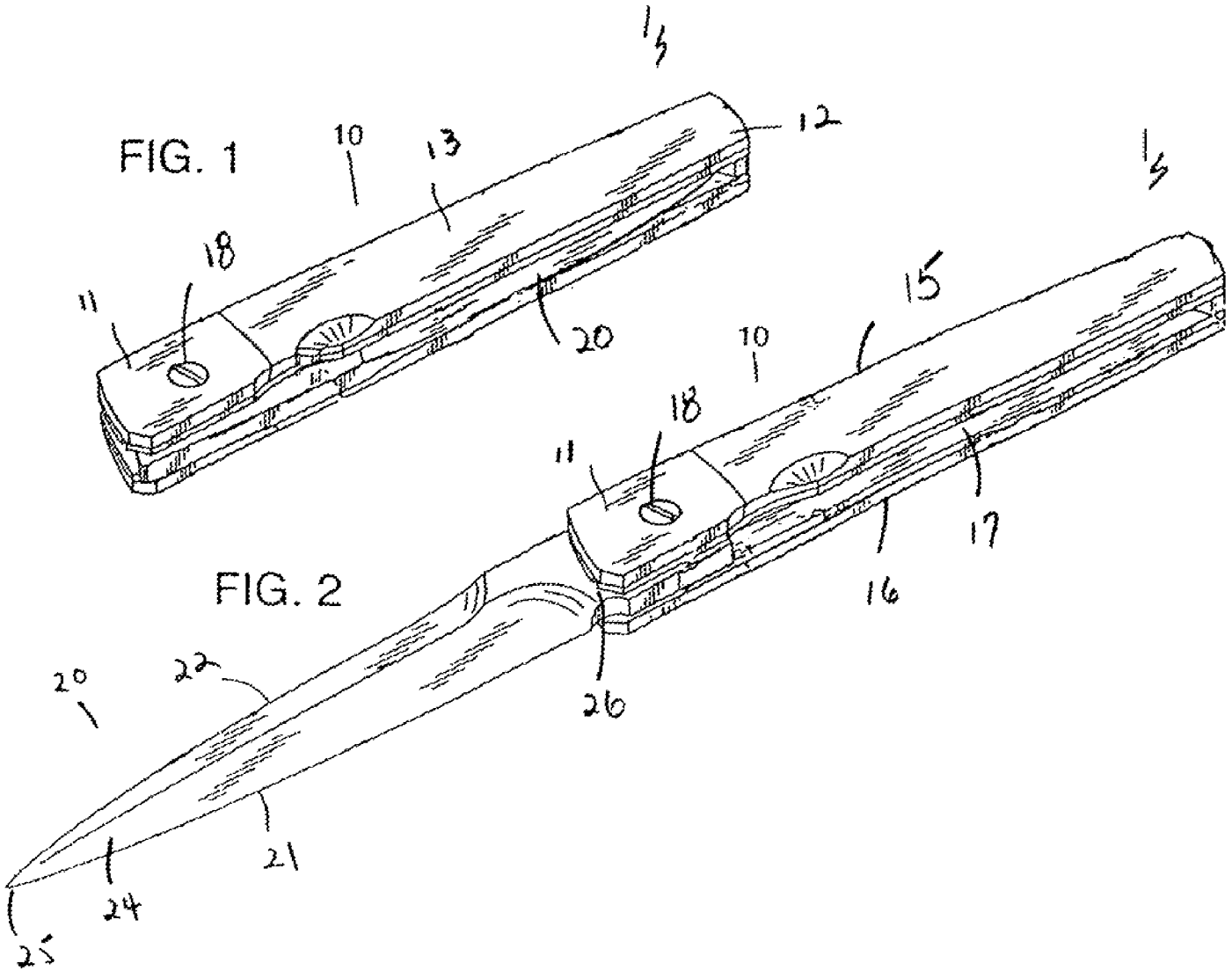
FIG. 1 is a side perspective view of a folding knife in a closed position.
FIG. 2 is a side perspective view of the knife of FIG. 1 in an open position.
Figure 3:
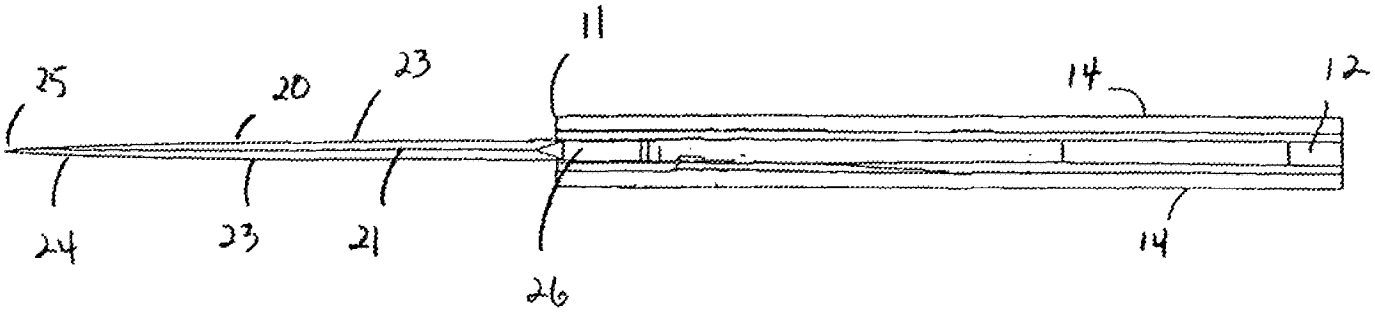
FIG. 3 is a bottom view of the knife of FIG. 2.
Figure 7:
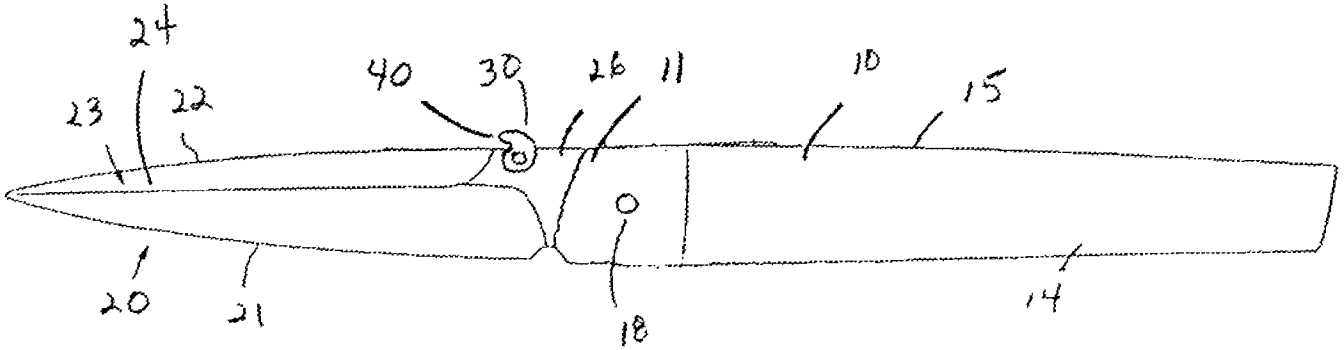
FIG. 7 is a side view of the knife of FIG. 2 with a knife opening assist.

Referring to the drawings in detail wherein like elements are indicated by like numerals, there is shown in FIGS. 1-3 a typical folding knife 1 comprised of a handle 10 and a blade 20 pivotally connected to said handle 10. The handle 10 has a forward end 11, a rear end 12, an elongated body 13 interconnecting said front and rear ends, said elongated body having two opposite sides 14, a top 15 and a bottom 16, said bottom having an elongated cavity 17 extending from said forward end 11 near to said rear end 12. The handle forward end 11 and rear end 12 define a handle longitudinal axis. The blade 20 has a primary cutting edge 21, a secondary edge 22, two opposite, generally flat sides 23, a forward end portion 24 terminating in a tip 25, and a rear end portion 26, said forward end and rear end portions defining a blade longitudinal axis. The blade rear end portion 26 has a first aperture 27 formed therein. The blade 20 is rotatably interconnected to the forward end 11 of the handle by means of a pin 18 through the handle sides 14 near to the handle forward end 11, said pin 18 engaging the blade rear portion first aperture 27.

The knife 1 has an open position, wherein the blade 20 is in a first extended position of use and having its longitudinal axis positioned substantially co-extensive with the handle longitudinal axis. The knife 1 has a closed position wherein the blade 20 is pivoted rearward about the pin 18 with the blade cutting edge 21 substantially inserted into said handle elongated cavity 17, said blade longitudinal axis and handle longitudinal axis having a substantially parallel relationship.

Figure 4:
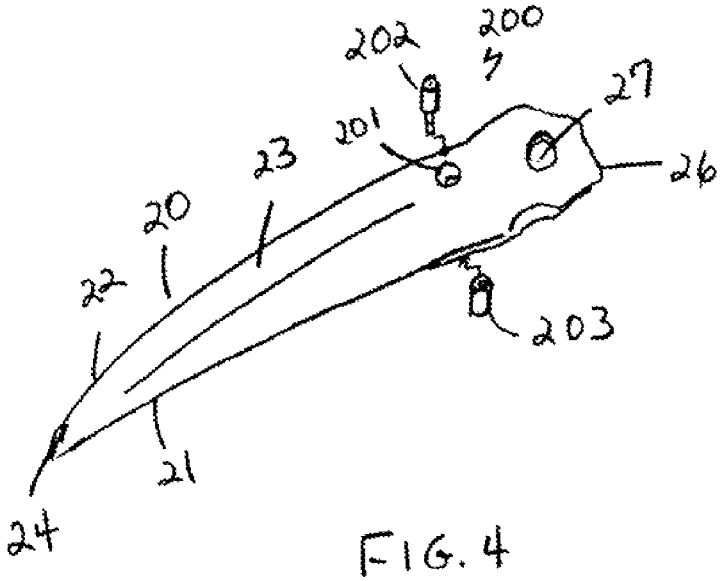
FIG. 4 is a side perspective view of a studded blade.

In various embodiments of folding knives, the knife blade 20 may be modified near to its rear end portion 26. FIG. 2 illustrates a plain knife blade 20. FIG. 4 illustrates a knife blade 20 with a stud assembly 200 attached to said blade 20 near to the blade rear end portion 26. The stud assembly 200 is attached to the blade 20 through a smooth second aperture 201 formed through the blade sides 23. The stud assembly 200 may be comprised of a stud bolt 202 threadingly engaged through the smooth second aperture 201 with a stud nut 203. As may be seen in FIG. 5 some blades will have a second aperture 205 formed near to the blade rear end portion 26. As may be seen in FIG. 6, other blade sides may have an elongated groove 207 running longitudinally adjacent to the secondary edge 22. The assist 30 of the present invention is designed to work with knife blades which are smooth, which have studs 200, which have a second aperture 205, which have elongated side grooves 207, or any combination of the above.

Figure 9:
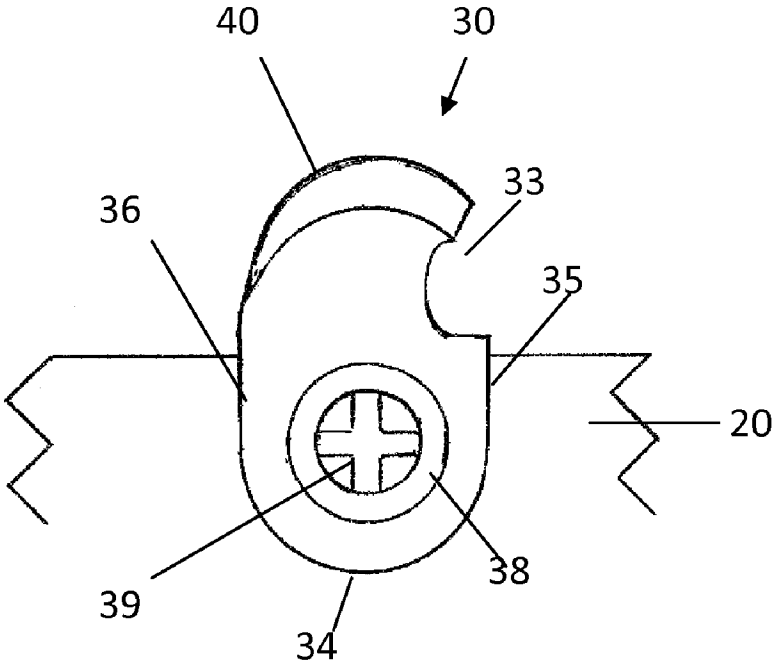
FIG. 9 is a side view of a knife opening assist mounted on a blade.
Figure 13:
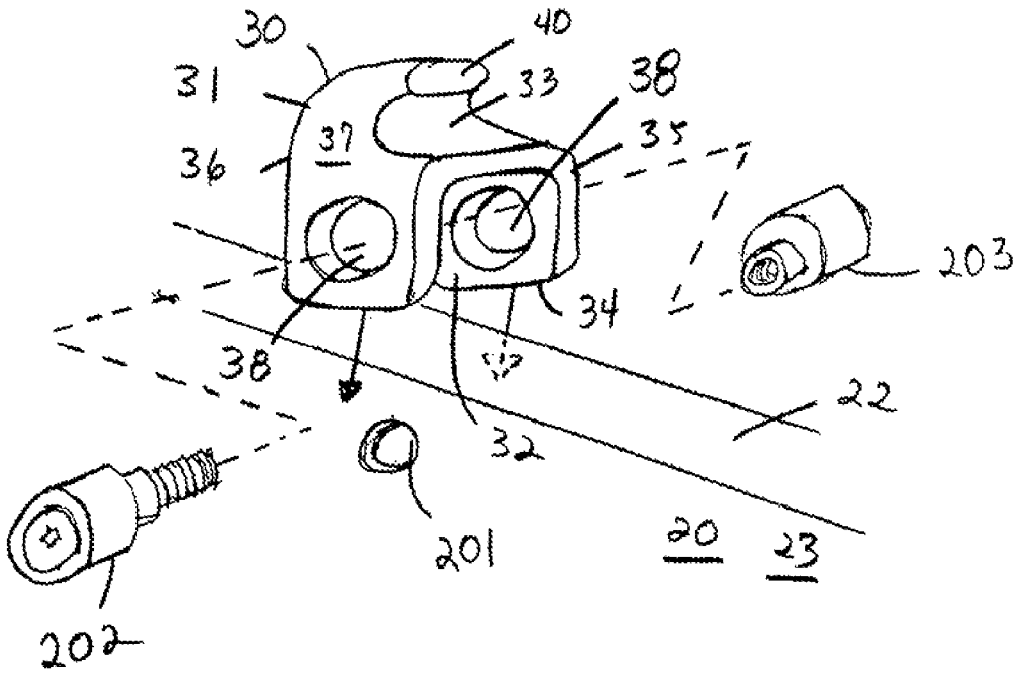
FIG. 13 is a side perspective view of the invention with a smooth aperture.
Figure 12:
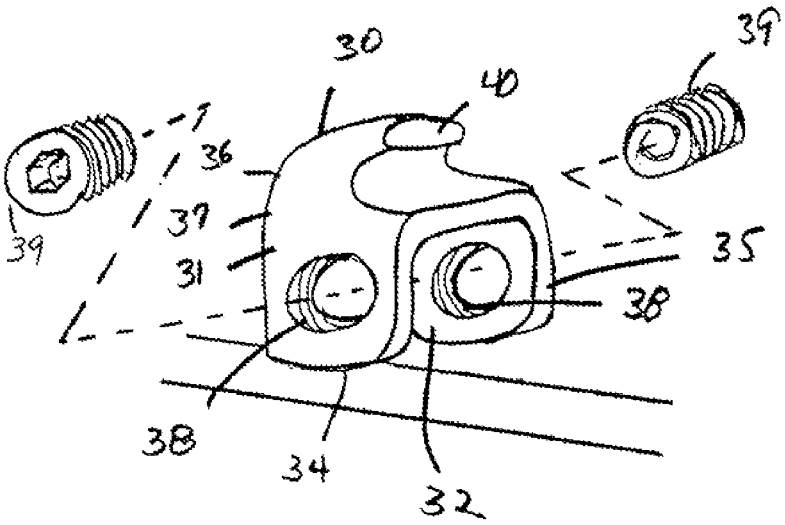
FIG. 12 is a side perspective view of the invention with a threaded aperture.
Figure 11:
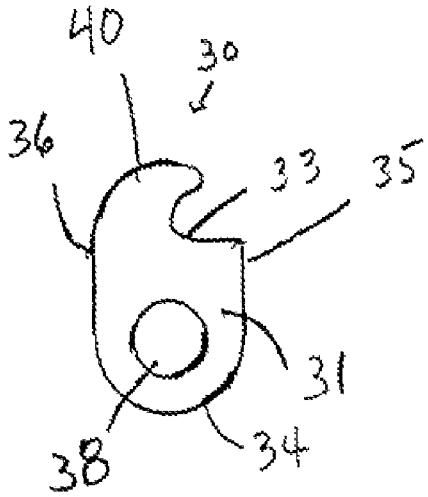
FIG. 11 is an elevational side view of a knife opening assist.
Figure 16A:
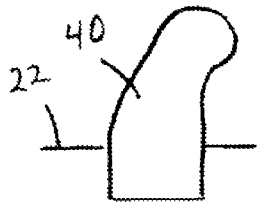
FIGS. 16A-16C are side views of assists with varying hook profiles.
Figure 16B:
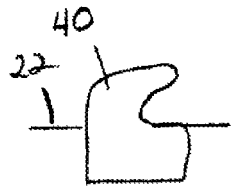
Figure 16C:
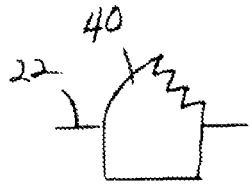

Referring to the remaining drawings, the knife opening assist 30 is removably attached to the knife blade 20. The assist 30 is comprised of an attachment element 31 with a channel 32 formed therein for positioning over a portion of the blade secondary edge 22. The attachment element 31 has a top 33, a bottom 34, a front end 35, a rear end 36, and two opposite sides 37. The channel 32 is formed in the element bottom 34 extending from front end 35 to rear end 36, said front end and rear end defining a channel longitudinal axis. Each side 37 has an aperture 38 formed therein, each said aperture 38 opening into said channel 32. The aperture 38 may be threaded as shown in FIG. 12 or smooth as shown in FIG. 13. The attachment element top 33 is formed into the shape of an upwardly and forwardly projecting hook 40, said hook projecting in the direction of the attachment element front end 35. The hook may have various shapes, e.g., height, length, contour, for specific uses. FIG. 9 illustrates a hook 40 with a classic shape. FIGS. 16A-16C illustrate hooks 40 with other contour variations. The hook 40 is adapted to snag a pocket, holster or other container as the folding knife 1 is being drawn out for use, thereby pivotally pulling the blade 20 out of the cavity 17.

Figure 17:
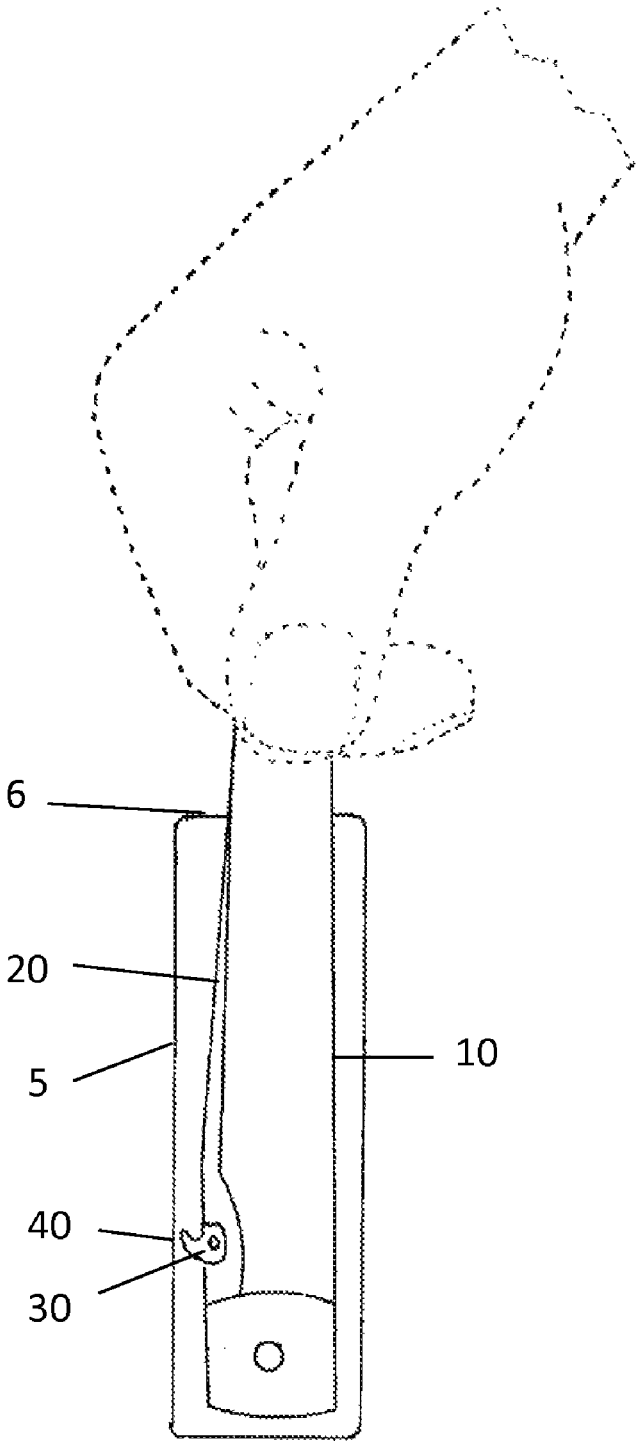
FIG. 17 is a cutaway side view of a knife and container according to one embodiment of the invention.
Figure 19A:
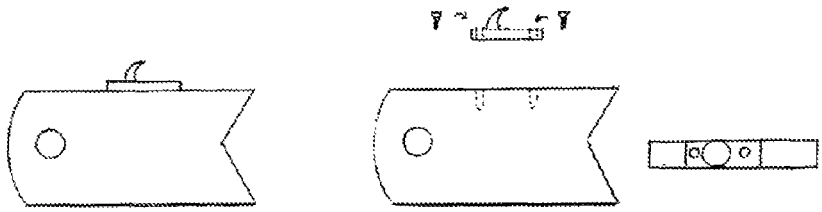
FIG. 19A is a diagram of a screw attachment in which the knife opening assist is mounted to one or more machined holes in the blade's secondary edge.
Figure 19B:
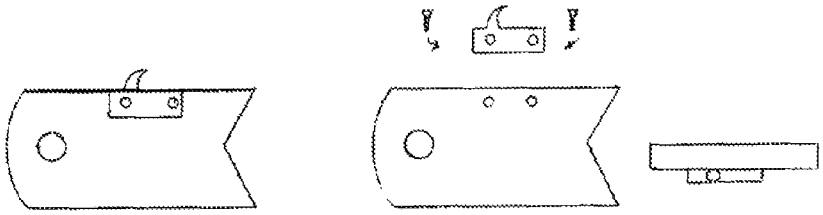
FIG. 19B is a diagram of a screw attachment in which the knife opening assist is mounted to one or more machined holes in the side of the blade.
Figure 19C:
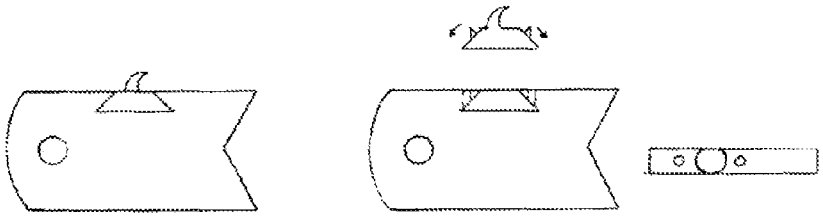
FIG. 19C is a diagram of at least one spring enabled latch on an end of the knife opening assist which is then mounted in a knife slot. The knife opening assist is slid in from the side while depressing the one or more latches. When the knife opening assist is inserted completely, the one or more latches spring up into the chambers. To remove the knife opening assist, a pin is pushed into each pin hole compressing the respective spring-loaded latch while the knife opening assist is slid sideways and out.
Figure 19D:
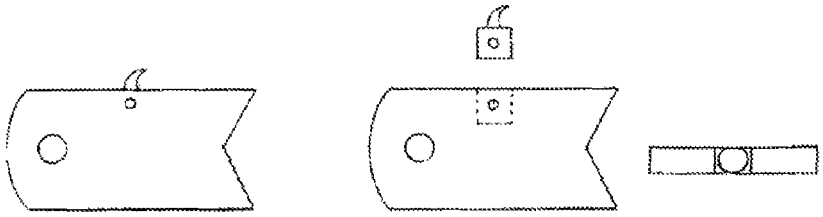
FIG. 19D is a diagram of a tension pin attachment where the knife opening assist is inserted into a cavity of the knife. One or more removable tension pins are then driven into one or more matched holes in the knife and the knife opening assist. To remove the knife opening assist, the one or more removable tension pins are driven out of the respective one or more holes.
Figure 19E:
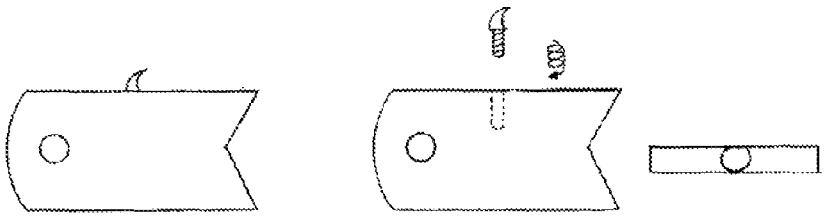
FIG. 19E is a diagram of a threaded stud which is part of the knife opening assist and is screwed into a threaded hole of the knife. To remove the knife opening assist, the knife opening assist is unscrewed from the threaded hole. Temporary threadlock adhesive or other thread locking methods can be used to assure alignment of the knife opening assist.

FIG. 17 shows an exemplary knife 1 being withdrawn from a container 5. FIGS. 18A-18E show an exemplary folding knife 1 with a hook 40 in various stages of withdrawal from a container 5. As shown the hook 5 is adapted to snag a container lip 6 or edge as the folding knife 1 is being drawn out for use, thereby pivotally pulling the blade 20 out of a cavity 17 in the knife handle 10. The container 5 may be a clothing pocket or a holster.

Figure 5:
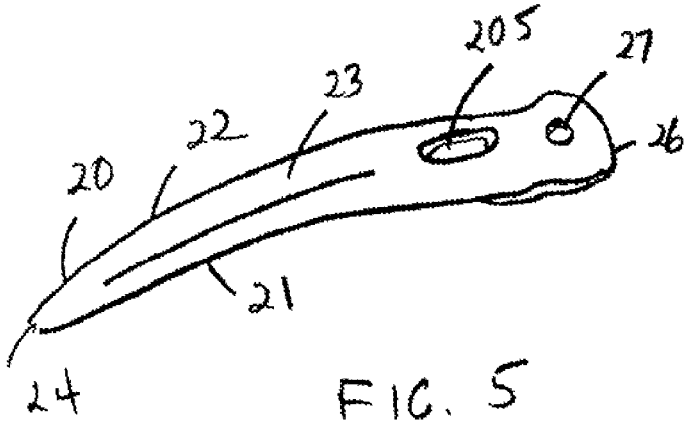
FIG. 5 is a side perspective view of a blade with a larger aperture.
Figure 6:
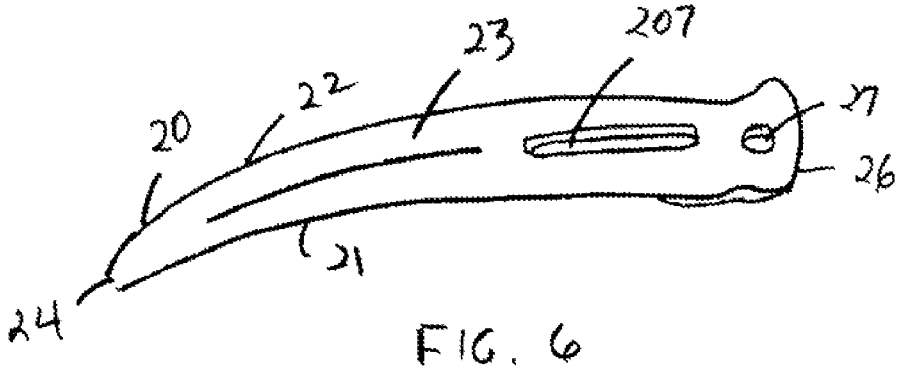
FIG. 6 is a side perspective view of a slotted blade.
Figure 8:
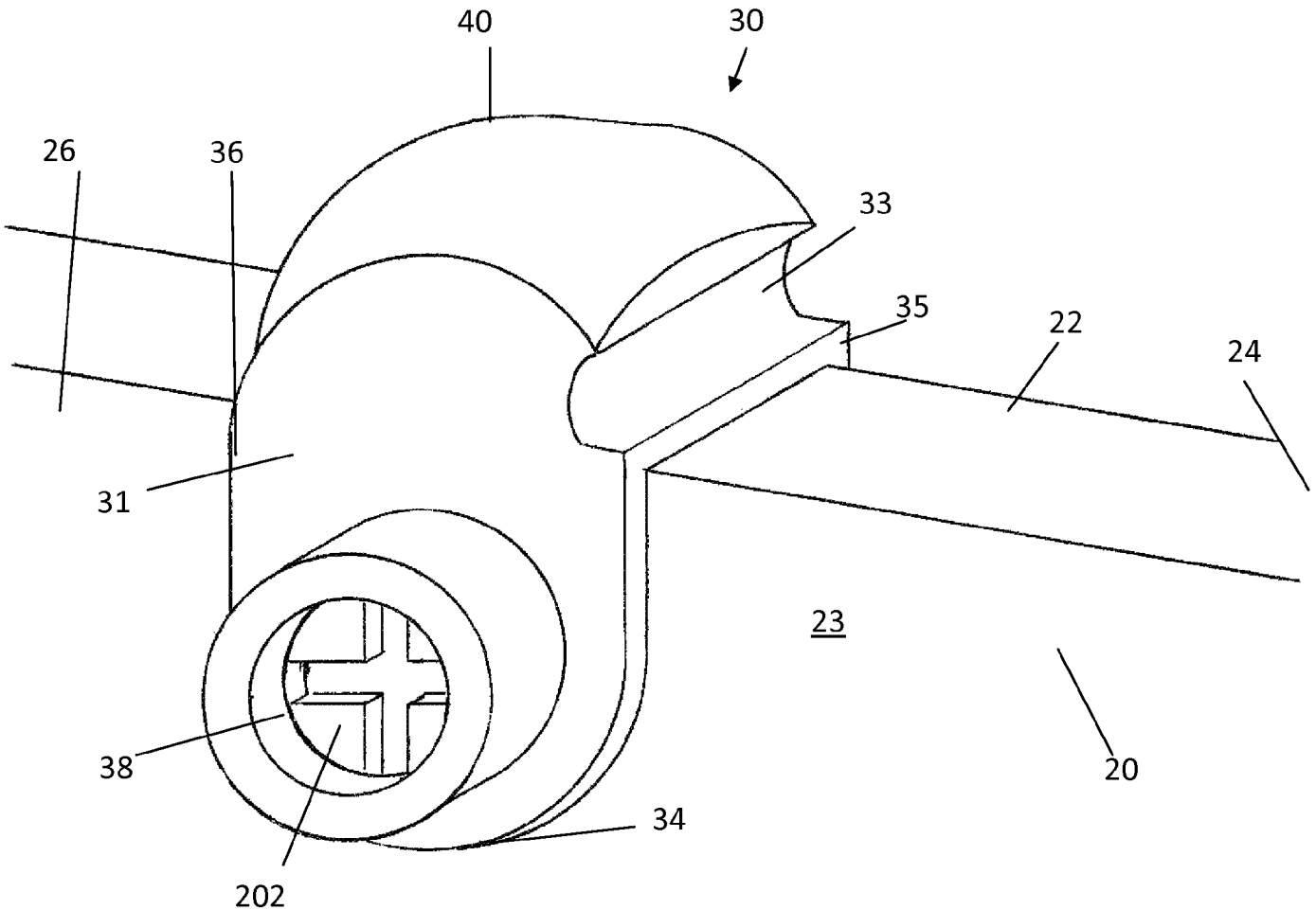
FIG. 8 is a side perspective view of the knife opening assist mounted on a blade.
Figure 10:
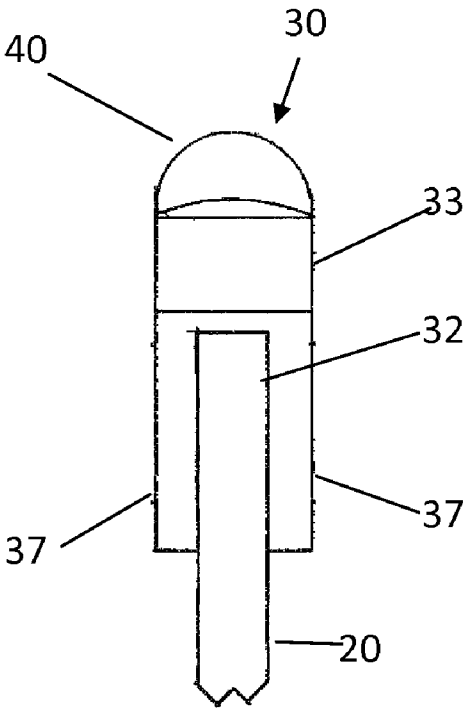
FIG. 10 is a front view thereof.
Figure 14E:
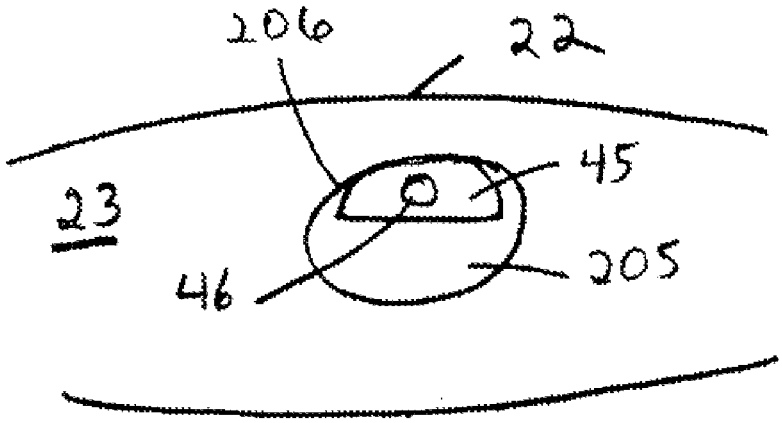
FIG. 14E is a side view of the insert positioned in a blade aperture.
Figure 14A:
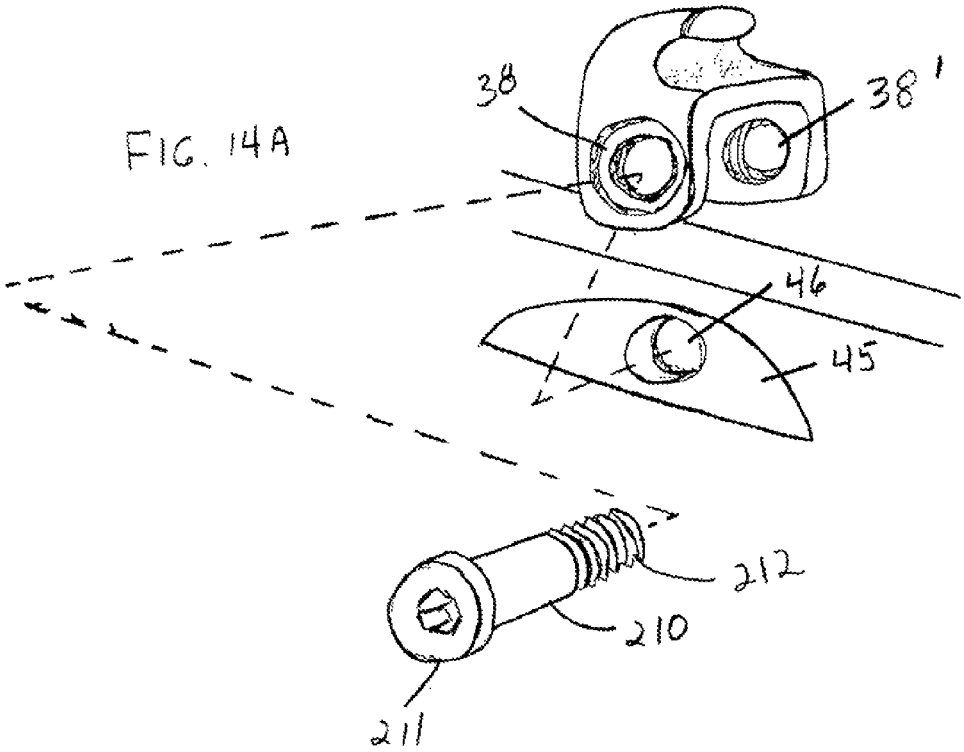
FIG. 14A is a side view of another embodiment of the invention.
Figure 14B:
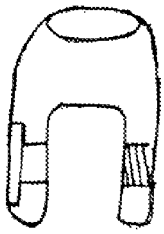
FIG. 14B is a cross sectional view of the assist shown in FIG. 14A.
Figure 14C:
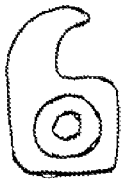
FIG. 14C is a side view of the assist shown in FIG. 14A.

The assist 30 is further comprised of means for attaching the assist 30 to blade 20. In one embodiment of the invention, the attachment means is comprised of a threaded lockable set screw 39 threadingly engaging each threaded aperture 38. See FIGS. 9 and 12. The assist 30 is positioned onto the blade secondary edge 22, wherein the attachment element channel 32 fits over the blade secondary edge 22, said attachment element sides 37 overlapping a portion of the blade sides 23. The attachment element front end 35 faces the blade forward end portion 24 and said attachment element rear end 36 faces the blade rear end portion 26. Where the blade sides 23 are solid, the assist 30 is used with two threaded lockable set screws 39, one for each attachment element aperture 38. The screws 39 hold the assist 30 in place on the blade 20.

Where a studded knife blade 20 as shown in FIG. 4 is provided, the assist 30 of FIGS. 8 and 13 are used, said assist having smooth bore apertures 38 adapted for use in conjunction with the stud assembly 200. The assist apertures 38 are aligned with the blade second aperture 201. The stud bolt 202 and stud nut 203 are threadingly joined through the smooth assist apertures 38 and blade second aperture 201. See FIG. 13.

Where there is a blade second aperture 201 or 205, such as shown in FIGS. 4 and 5, one long lockable bolt or set screw 210 may be used, said bolt 210 extending from one element aperture 38, through the blade second aperture 201 or 205, and into the opposite element aperture 38. The assist apertures 38 may be designed so that one aperture 38 is smooth and countersunk for accommodating the bolt head 211. The opposite aperture 38' may be threaded to threadingly engage the bolt threads 212. See FIGS. 14A-C.

Figure 14D:
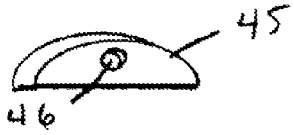
FIG. 14D is a side perspective view of an insert used in FIG. 14A.

In another embodiment of the invention, an assist insert 45 having the general circumferential shape of the blade second aperture 205 may be used. See FIGS. 14D and 14E. The insert 45 has an aperture 46 having a central axis concentric with the assist apertures 38, 38'. The insert aperture 46 accommodates a threaded lockable long bolt or set screw 210 which goes through smooth apertures 38 and 46 and engages the opposite assist threaded aperture 38'. See FIG. 14A.

Figure 15A:
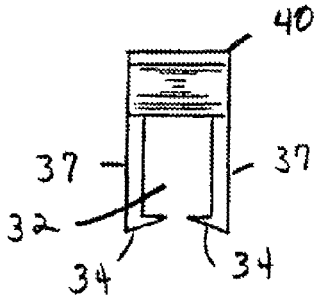
FIG. 15A is a front view of an assist with bottom clip.
Figure 15B:
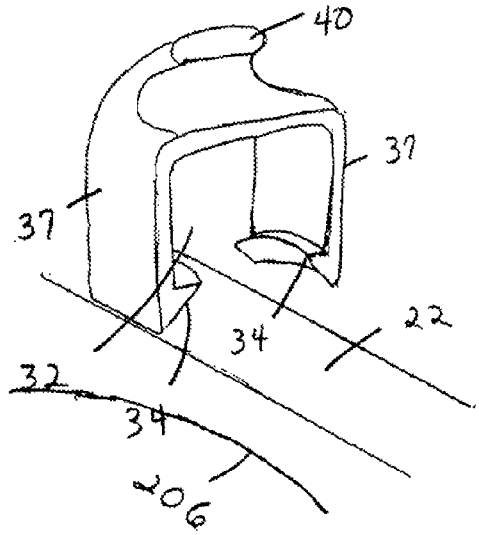
FIG. 15B is a front perspective view of an assist with a bottom clip.

In still another embodiment, the assist bottom 34 may be formed into a clip shape adapted to grasp a blade second aperture upper edge 206. See FIGS. 15A and 15B.

The present invention adds a knife opening assist 30 enabling the simultaneous drawing and opening of a folded knife during a weapon's draw, resulting in a one-step weapon draw. The assist attachment hook-shaped element 40, oriented toward the forward end of the blade, is adapted to snag a pocket, holster or other container as the folding knife is being drawn out for use. The assist 30 thereby draws the blade 20 out of the handle cavity 17 as the knife is being drawn from its container, i.e., pocket or holster.

Figures 20A, 20B:
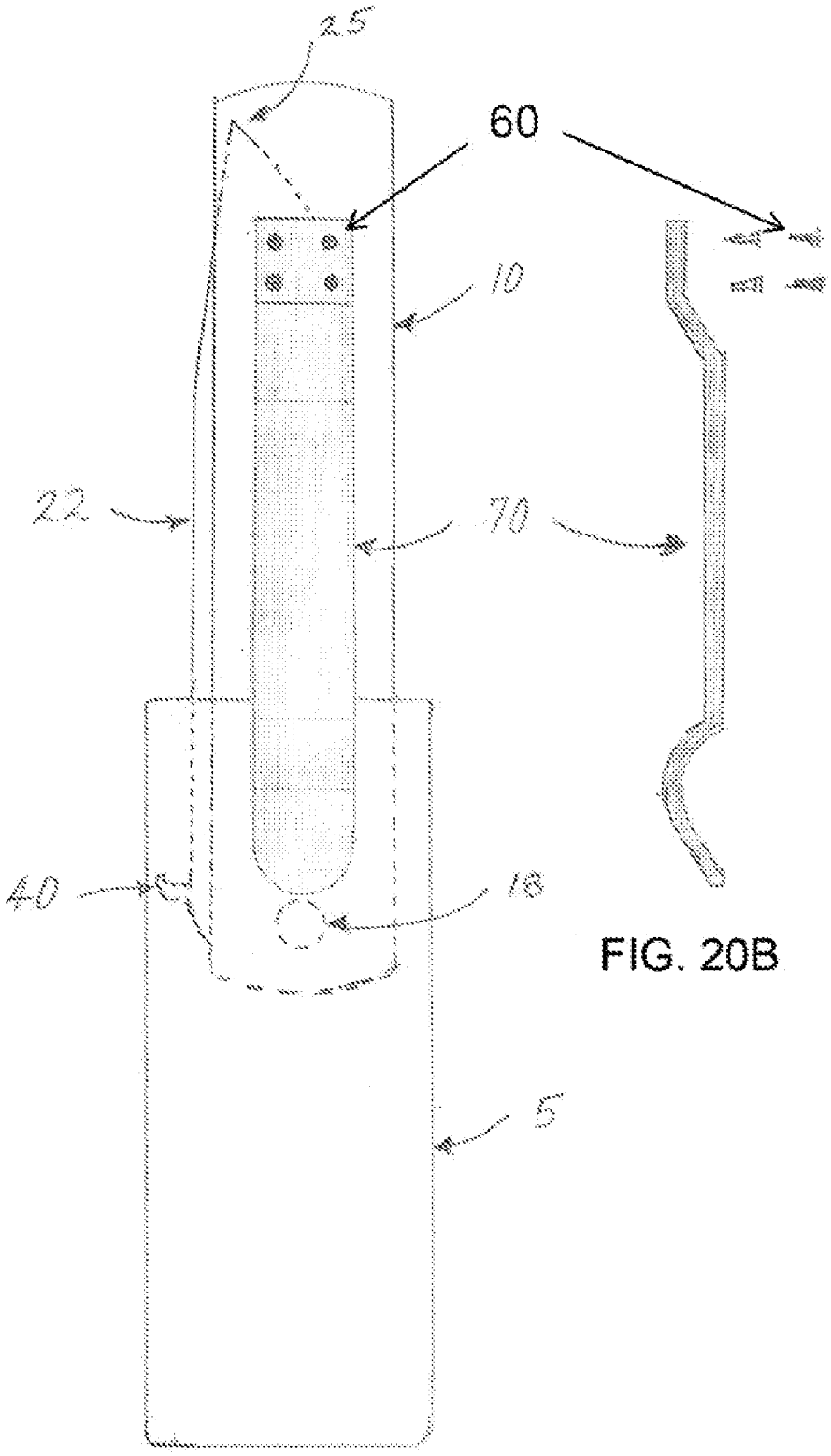
FIG. 20A is a side view of a folding pocket knife having a clip on one side as the folding pocket knife is being withdrawn from a container.
FIG. 20B is an exploded view of the clip and one method of using screws to attach the clip to the handle of the folding pocket knife.

FIG. 20A shows one method used to orient the folding pocket knife so that the knife opening assist will properly engage the holster, pocket or other container. The pocket 5 is that of a right upper-thigh trouser pocket for use with a right handed draw. The clip 70 is placed exterior to the pocket while the knife handle 10 is placed interior. In this orientation, the knife opening assist 40 is located rear toward the trouser buttocks region. The blade pivot pin 18 is located downward in the pocket, opposite to the clip 70 attachment point. The blade tip 25 is located upward of the pocket relatively adjacent to the clip 70 attachment point. Notice that the knife opening assist 40 is attached to the blade's secondary edge 22.

In additional embodiments, the knife opening assist is a removable attachment to the knife blade. Its construction will vary based on the method of attachment. Ultimately there are many ways to attach the assist. Knife opening assists with a channel have already been displayed and discussed. We now describe alternative systems and methods of attachment of the knife opening assist, systems and methods which do not use a channel in the knife opening assist. These alternative constructions and methods of assembly are illustrated in FIG. 19A through FIG. 19E. In each figure, a side elevation view of the knife opening assist as assembled to a knife blade is illustrated on the left side of each figure, an exploded view of the knife opening assist that illustrates the parts thereof is shown in the center of each figure, and a top view of the knife opening assist as assembled to a knife blade is illustrated on the right side of each figure.

Furthermore knife opening assists can be retrofitted to existing or conventional knives (that is, to knives which were not designed with the original intent of utilizing a removable knife opening assist) or they may be fitted to custom knives (that is, to knives which are designed for specific use with the removable knife opening assist).

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A removable knife opening assist for use in conjunction with a pre-existing folding knife having a blade with a sharp edge, a blade secondary edge opposite to the sharp edge, and a sharp tip, the folding knife having the blade foldably attached to a knife handle, the removable knife opening assist for use in conjunction with a pre-existing container for containing the folding knife in a folded condition, the removable knife opening assist comprising:

an upwardly and forwardly projecting hook; and an attachment element connected to said hook and configured to removably attach said hook to a portion of the blade secondary edge opposite to the sharp blade edge of the folding knife, said hook projecting in the direction of a front end of said attachment element, said hook configured to face toward a sharp tip of the blade of the folding knife so as to snag said container as the folding knife is being drawn out of the container for use;

said removable knife opening assist configured to automatically open the folding knife during removal of the folding knife from the container, and said removable knife opening assist configured to not require any manipulation of the removable knife opening assist during removal other than the simple withdrawal of the folding knife from the container.

2. The removable knife opening assist of claim 1, wherein said attachment element comprises at least one screw.

3. The removable knife opening assist of claim 1, wherein said attachment element comprises at least one spring enabled latch.

4. The removable knife opening assist of claim 1, wherein said attachment element comprises at least one removable pin.

5. The removable knife opening assist of claim 1, wherein said attachment element comprises one threaded stud.

6. The removable knife opening assist of claim 1, further comprising an alignment portion having a channel formed therein, said channel configured to position said alignment portion over a portion of said blade secondary edge opposite to a sharp blade edge of the pocket folding knife, said alignment portion connected to said hook and to said attachment portion.

7. The removable knife opening assist of claim 6, wherein said attachment element comprises a threaded attachment element.

8. The removable knife opening assist of claim 6, wherein said attachment element comprises a clip attachment element.

* * * * *